US011813625B2

(12) United States Patent
Brugger

(10) Patent No.: US 11,813,625 B2
(45) Date of Patent: Nov. 14, 2023

(54) DISPENSER

(71) Applicant: Gerhard Brugger, Pflach (AT)

(72) Inventor: Gerhard Brugger, Pflach (AT)

(73) Assignee: Dual Dispensers GmbH, Pflach (AT)

( * ) Notice: Subject to any disclaimer, the term of this patent is extended or adjusted under 35 U.S.C. 154(b) by 0 days.

(21) Appl. No.: 16/854,025

(22) Filed: Apr. 21, 2020

(65) Prior Publication Data

US 2020/0246818 A1 Aug. 6, 2020

Related U.S. Application Data

(62) Division of application No. 15/120,955, filed as application No. PCT/EP2015/000458 on Feb. 27, 2015, now Pat. No. 10,661,290.

(30) Foreign Application Priority Data

Feb. 27, 2014 (DE) ..... 20 2014 001 720.4
Nov. 29, 2014 (DE) ..... 20 2014 009 449.7

(51) Int. Cl.
*B05B 11/04* (2006.01)
*B65D 47/32* (2006.01)
(Continued)

(52) U.S. Cl.
CPC ..... *B05B 11/048* (2013.01); *B05B 11/0054* (2013.01); *B05B 11/0078* (2013.01);
(Continued)

(58) Field of Classification Search
CPC ..... B05B 11/048; B05B 11/0054; B05B 11/0078; B05B 11/0097; B05B 11/047;
(Continued)

(56) References Cited

U.S. PATENT DOCUMENTS 2,367,883 A 1/1945 Miller
2,608,320 A * 8/1952 Harrison, Jr. ..... B65D 83/0055 222/401
(Continued)

FOREIGN PATENT DOCUMENTS

CN 101023005 8/2007
CN 201321224 Y 10/2009
(Continued)

OTHER PUBLICATIONS

European Patent Office, International Search Report; dated May 27, 2015.

*Primary Examiner* — Paul R Durand
*Assistant Examiner* — Randall A Gruby
(74) *Attorney, Agent, or Firm* — Price Heneveld LLP

(57) ABSTRACT

A dispenser for substances includes an outer shell with a deformable outer wall which encloses the deformable container arrangement and at least one balancing valve for balancing air, wherein an air filled intermediary gap is located between the outer wall and the container arrangement and the dispenser is configured to dispense substances after pressure loading the outer shell, wherein the container arrangement includes at least two containers and a common dispensing head are connected with each other pressure tight in at least one portion, and wherein at least one of the containers includes self-closing filling valves which are configured to be openable by pressure during filling the at least two containers.

16 Claims, 12 Drawing Sheets

(51) Int. Cl.

| | |
|---|---|
| ***B65D 81/32*** | (2006.01) |
| ***B65D 83/00*** | (2006.01) |
| ***B05B 11/00*** | (2023.01) |
| *A45D 19/00* | (2006.01) |

(52) U.S. Cl.
CPC ..... *B05B 11/0097* (2013.01); *B05B 11/047* (2013.01); *B65D 47/32* (2013.01); *B65D 81/3244* (2013.01); *B65D 83/0061* (2013.01); *A45D 19/0066* (2021.01); *A45D 2200/058* (2013.01); *B65D 2205/02* (2013.01)

(58) Field of Classification Search
CPC ..... B65D 47/32; B65D 81/3244; B65D 83/0061; A45D 2200/058
See application file for complete search history.

(56) References Cited

U.S. PATENT DOCUMENTS 3,223,289 A * 12/1965 Bouet ..... B05B 11/00446 401/153
3,236,418 A 2/1966 Francois
3,240,399 A * 3/1966 Frandeen ..... B05B 11/0094 222/211
3,269,389 A * 8/1966 Meurer ..... B05B 11/048 128/200.14
3,306,500 A * 2/1967 Williams ..... B65D 35/24 222/386.5
3,399,811 A 9/1968 Miller
3,709,437 A 1/1973 Wright
3,874,428 A 4/1975 Golay
4,020,978 A * 5/1977 Szczepanski ..... B65D 35/28 222/209
4,091,849 A 5/1978 Stevenson
4,148,419 A 4/1979 MacNair
4,159,790 A * 7/1979 Bailey ..... B05B 15/30 222/464.2
4,300,555 A 11/1981 Kopito
4,322,020 A * 3/1982 Stone ..... B05B 11/026 222/394
4,363,336 A 12/1982 Cerrato
4,469,250 A * 9/1984 Evezich ..... B65D 83/0055 222/83.5
4,488,572 A 12/1984 Brown
4,585,149 A * 4/1986 Zulauf ..... B65D 81/3244 222/144.5
4,687,663 A 8/1987 Schaeffer
4,715,414 A 12/1987 Harrison
4,760,937 A * 8/1988 Evezich ..... B65D 83/0055 222/209
4,764,046 A 8/1988 Kitamura
4,838,457 A * 6/1989 Swahl ..... B65D 83/0055 222/548
4,938,412 A 7/1990 Berfield
4,951,840 A 8/1990 Brison
4,993,594 A * 2/1991 Becker ..... B05B 11/048 239/323
5,102,010 A 4/1992 Osgar
5,108,007 A * 4/1992 Smith ..... B05B 11/0072 222/212
5,156,300 A * 10/1992 Spahni ..... B05B 11/048 222/464.2
5,169,029 A 12/1992 Behar
5,252,304 A 10/1993 Miyoshi
5,273,191 A * 12/1993 Meshberg ..... B05B 11/00442 222/402.1
5,282,304 A * 2/1994 Reiboldt ..... B65D 47/2075 29/451
5,305,921 A * 4/1994 Kock ..... B05B 11/026 222/464.2
5,305,925 A 4/1994 Vogel
5,366,115 A * 11/1994 Kersten ..... B65D 47/18 222/548
5,377,875 A * 1/1995 Kock ..... B65D 83/0055 222/464.2
5,398,846 A 3/1995 Corba
5,615,803 A 4/1997 Hatakeyama
5,752,636 A 5/1998 Bachand
6,042,850 A * 3/2000 Ida ..... A61J 11/0085 215/11.4
6,216,915 B1 * 4/2001 Harman ..... B65D 81/3244 222/391
6,220,483 B1 4/2001 van der Heijden
6,241,125 B1 6/2001 Jacobsen
6,302,607 B1 * 10/2001 Burrowes ..... A45D 34/04 401/23
6,308,862 B1 * 10/2001 Fillmore ..... B05B 11/1053 222/215
7,240,808 B2 7/2007 Brugger
7,870,977 B2 1/2011 Pietrowski
8,118,183 B2 * 2/2012 Iwahashi ..... B65D 83/0055 215/385
8,579,156 B2 11/2013 Rasmussen
9,193,579 B2 11/2015 Brugger
9,321,580 B2 * 4/2016 Kuriyama ..... B32B 7/12
9,410,837 B2 8/2016 Brugger
9,776,787 B2 * 10/2017 Nakajima ..... C11D 17/041
9,908,127 B2 * 3/2018 Borel ..... B65D 83/425
11,072,450 B2 * 7/2021 Furusawa ..... B65D 1/0215
2001/0025859 A1 10/2001 Dumont
2002/0179736 A1 12/2002 Ogata et al.
2004/0065678 A1 4/2004 Gobbers et al.
2005/0077319 A1 * 4/2005 Binois ..... B05B 11/1084 222/105
2006/0054633 A1 3/2006 Brugger
2007/0119874 A1 * 5/2007 Geier ..... B65D 83/62 222/386.5
2007/0241133 A1 * 10/2007 Smith ..... B65D 83/62 222/129
2010/0112815 A1 5/2010 O'Dougherty
2012/0187153 A1 7/2012 Burge
2013/0299514 A1 * 11/2013 Holzmann ..... B05B 11/1005 222/137
2014/0061239 A1 3/2014 Brugger
2014/0361037 A1 * 12/2014 Green ..... B01F 25/4323 222/402.1
2016/0081452 A1 * 3/2016 Brugger ..... B01F 25/4414 401/171
2017/0367461 A1 * 12/2017 Tsubouchi ..... A61K 8/345
2019/0022682 A1 1/2019 Scherer
2020/0198876 A1 * 6/2020 Kamijyo ..... B65D 83/66
2021/0002064 A1 * 1/2021 Tsubouchi ..... B65D 83/752
2021/0031224 A1 * 2/2021 Brugger ..... B05B 11/048

FOREIGN PATENT DOCUMENTS

| | | |
|---|---|---|
| CN | 101918146 A | 12/2010 |
| CN | 202828389 U | 3/2013 |
| CN | 103547517 A | 1/2014 |
| DE | 8810049 | 1/1989 |
| DE | 692 08 264 | 8/1996 |
| DE | 20108495 U1 | 8/2001 |
| DE | 60008106 | 9/2004 |
| DE | 60320379 | 5/2009 |
| DE | 20 2008 015 776 | 1/2010 |
| DE | 102010009101 | 8/2011 |
| DE | 20 2011 002 558 | 3/2012 |
| DE | 102011056331 | 6/2013 |
| GB | 676094 | 7/1952 |

* cited by examiner

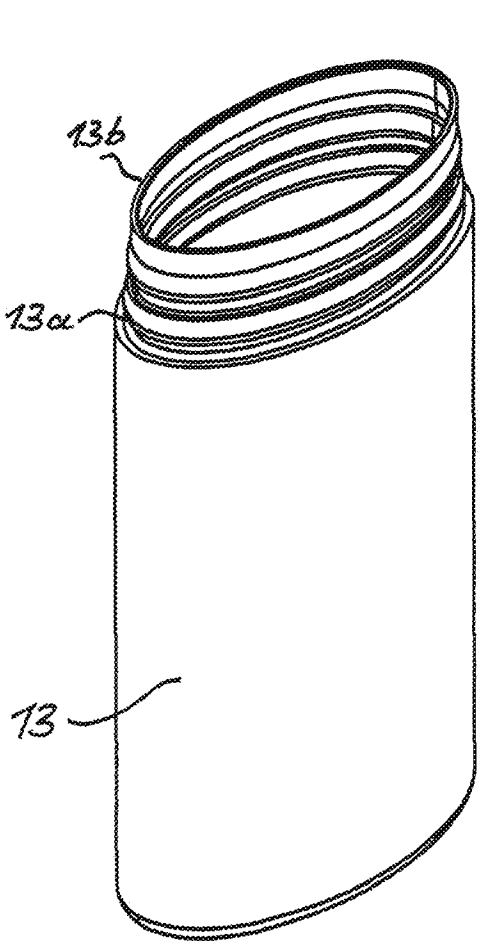
Fig. 3a
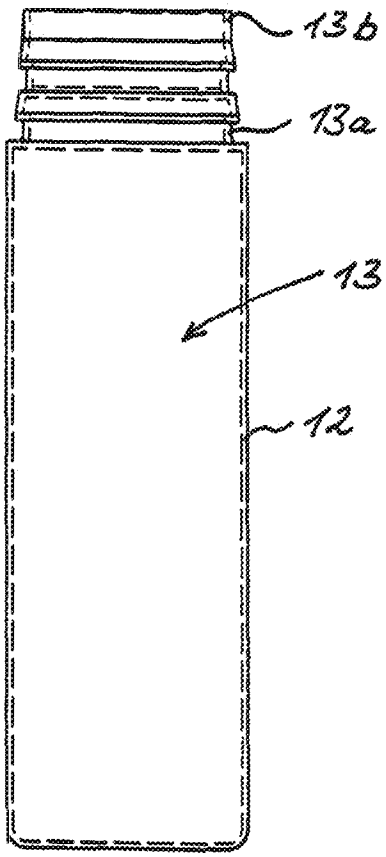
Fig. 3b
Fig. 3

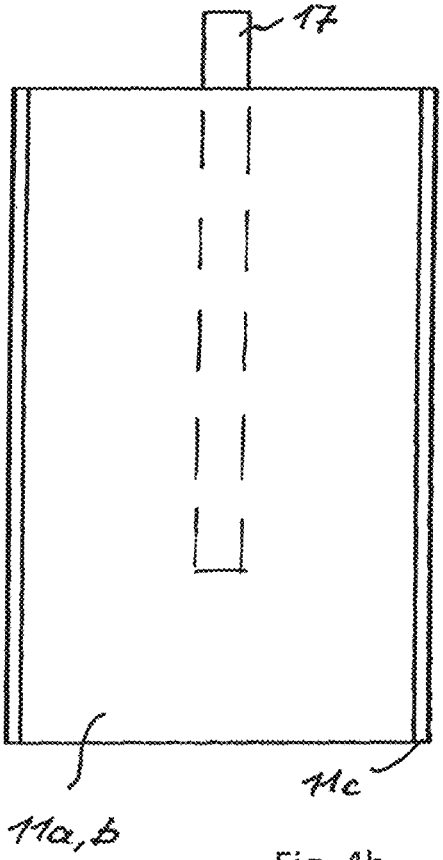
Fig. 4b
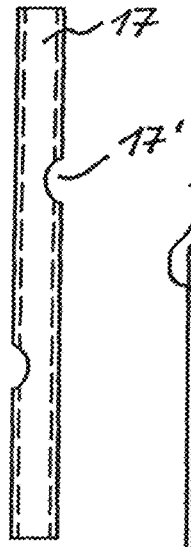
Fig. 4c
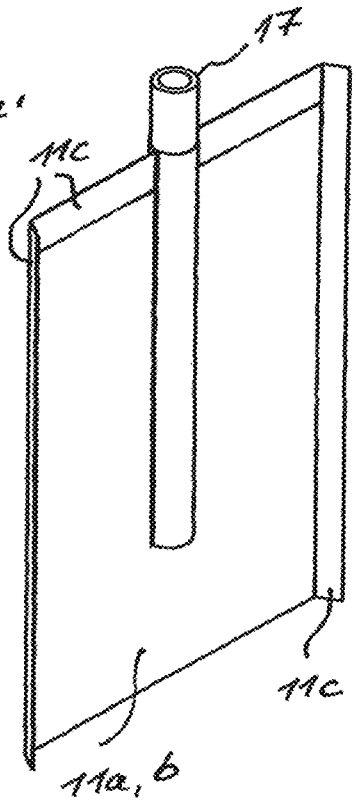
Fig. 4a
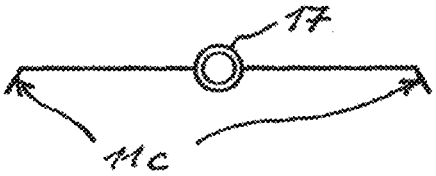
Fig. 4d
Fig. 4

DISPENSER

CROSS-REFERENCE TO RELATED APPLICATION

The present application is a Divisional of U.S. patent application Ser. No. 15/120,955 entitled "DISPENSER," filed Aug. 23, 2016 which is a national stage entry of PCT/EP2015/000458, filed on Feb. 27, 2015. The entire disclosures of each are incorporated herein by reference in their entirety.

BACKGROUND OF THE INVENTION

Substances like for example cosmetics, hair dyes but also glues or other chemicals are stored in containers which are provided with a dispensing device. As known from example from DE 692 08 264 in the form of a squeezing bottle with a one way bag included therein. These so called dispensers facilitate dispensing a defined amount of the substance and prevent simultaneously that air enters the containers. Furthermore these dispensers facilitate dispensing the substances without having to open screw tops or similar. It is a disadvantage of conventional dispensers that they typically include a pump mechanism which dispenses the substances from the only container through the dispenser so that complexity of the configuration is rather high in particular because two component dispensers are increasing required for cosmetics or hair care products.

In addition to the known dispensers also collapsible tubes are bottles are used for storing the substances recited supra wherein the collapsible tubes or bottles have dosing heads or dosing openings from which the substance exits after a direct pressure loading of the container. It is a disadvantage of these containers that no complete emptying of the substance of the container is performed, thus residual amounts of the substances remain which are typically expensive. Furthermore air can enter the interior of the container through the output opening which can lead to oxidation or spoiling of the substance. In order to address the problem and in order to prevent that air enters the container including the substance so called bag in bottle or bag in bag packaging is proposed. This includes an outer container, for example a plastic bottle made from a rather firm material or a collapsible tube in which a second container filled with the substance typically a blown bag is arranged. Dispensers of this type are typically used in the pharmaceutical industry or aerosols and are produced by a so called coextrusion method. Thus between the outer container and the bag enclosed by the outer container an intermediary space is provided which is filled with air when the outer packaging is pressure loaded it is compressed and transfers the pressure to the bag through the air included in the intermediary space. The substance then exits from the intermediary space through a respective output valve. Thus air can flow in in order to place the volume of the dispensed substance.

It is a disadvantage of the recited types of packaging that the typically coextruded inner containers are not diffusion tight and are thus less suitable for long term storage. Furthermore only a single substance can be received in the respective container. When substances have to be stored which only may be mixed during dispensing or shortly after dispensing since a premature reaction would occur otherwise no solution is provided so far. This is the case for example for multicomponent glues or particular cleaners or cosmetic products.

Thus it is an object of the invention to provide a dispenser which is simple in configuration and easily fillable and which additionally facilitates long term storage of two or more substances.

SUMMARY OF THE INVENTION

The dispenser according to the invention for substances is suited for storing and dispensing chemicals like components of multicomponent glues or of dyes but also for cosmetics or pasty or liquid substances. The dispenser thus includes an outer shell with a deformable outer wall and a container arrangement that is enclosed by the outer wall and also deformable. The deformability of the outer wall is thus adjusted so that the outer wall is deformable by simple pressure loading with one hand or plural fingers, thus however the wall has enough strength to provide stable support for the dispenser. When loading the outer shell with pressure which can also be provided a respective clamps or brackets it is provided that the substances stored in the interior container arrangement exit from the interior container arrangement. This is facilitated in that an air filled intermediary space is provided between the outer wall and the container arrangement and the pressure in parted upon the outer shell is evenly transmitted to the two or more containers of the container arrangement. In order to provide a filling of the intermediary space after putting out the stored substances the outer shell includes at least one inlet valve for balancing air. Through this balancing valve a corresponding amount of air flows into the intermediary space between the deformable outer wall of the outer shell and the container arrangement enclosed by the outer shell. The proposed dispenser for substances is characterized in that the container arrangement includes at least two container for separate storage of liquid or pasty substances. This configuration of the dispenser facilitates separate storage of substances in a single dispenser. Thus this dispenser facilitates for example that a two or multi component glue is stored in a single container but it also facilitates storage of particularly sensitive cosmetics like e.g. hair dyes which may only be mixed when exiting from the storage container in order to maintain for example their caring properties.

In order to increase storage time it is furthermore proposed that the exit portion of the containers includes at least substantial diffusion sealing, in particular made from metal, advantageously a respective aluminum cap or sleeve which is only penetrated or opened by the dispensing head, in particular by spikes provided thereon when the dispenser is being used. Thus the entire bag content is protected against incoming air, wherein opening the seal is provided advantageously by moving the dispensing head from a start or storage position into the operating position through interlocking.

In an advantageously embodiment it is provided that the substances stored in the container have identical or similar viscosities. Depending on the embodiment of the respective mixing device which can be additionally provided at the dispenser there is the option to keep the put out substance substantially constant. When in addition to a large amount of a first substance only a small amount of a second substance for example of a hardener shall be dispensed this can be adjusted by different cross sections of the dispensing openings. Through this dispenser a complicated storage of the substances to be mixed in separate containers is prevented. Additionally the dispenser can provide that a constant mixing ratio of the substances is always being dispensed. In addition to arranging two containers there is also the option to arrange more than two containers, for example for a three component glue in the dispenser.

It is perceived advantageous when the outer shell is made from a thermoplastic material using PE (polyethylene), PP (polypropylene) or PET (polyethylenterephthalat). The inner containers are advantageously made from a metal foil or a laminated multilayer foil, a so called barrier foil, wherein containers fabricated with sealing seams can be produced in a particularly cost effective manner and diffusion tight. Depending on the reactive properties of the stored substances a metal coating of the plastic material can be additionally provided. A respective coating is also advantageous for keeping the product fresh since this coating can find an antibacterial effect.

It is advantageous to form the container as a cost effective foil bag with 2, 3 or also 4 sealing seams per container bag. Thus the two or more bags can be combined into a multi chamber bag through adjacent seal grooves. Thus also a separate storage of the substances is possible, e.g. during inserting into the outer shell by hand or machine is substantially simplified. The dispenser with inserted and filled bags is thus actuated as follows. The relatively resilient outer wall of the outer shell is squeezed together by hand or with a clamp. Thus a positive pressure e.g. 0.5 bar is created in an interior of the dispenser wherein the pressure directly impacts the bags arranged at this location and thus completely evenly. Based on the air filled intermediary space enveloping the containers an even loading of both bags is provided so that both bags respectively dispense an identical amount of a substance or of plural substances for identical outlet cross sections wherein the amount is independent from the force of pressure loading the outer shell.

An advantageous embodiment provides that the dispenser is provided as a disposable container. A dispenser of this type is discarded after retrieving the entire substance stored therein. Thus the containers and the outer wall can be connected in at least one portion, in particular connected pressure tight through corresponding seal lips. For connecting purposes certainly also a subsequent welding of the containers and the outer wall can be provided. This prevents that the containers collapse in the housing after partial emptying so that a complete retrieval of the substances from the containers is not possible anymore. Through the connection between the container and the outer wall at least in a portion the containers remain aligned in the dispenser until they are emptied completely. This is also achieved when a tube is welded into each container wherein a free end of the tube is used for connecting with the common dispensing head and by each container having a check valve or filling valve for liquids.

For simplified retrieval and mixing the substances as required it is advantageous to provide an applicator that is connected with the outer shell. The containers are thus connected with the applicator through channels or conduits. The applicator can include for example two dispensing openings that are arranged adjacent to each other or accordingly two or more annular gaps that are arranged concentrical wherein the substances are separately put out through the concentric annular gaps and mix only when exiting from the applicator.

Is furthermore advantageous that the dispenser can be configured as a reusable container thus it includes replaceable or refillable containers in its interior. In order to be able to retrieve the empty containers or in order to be able to perform a refill the dispenser includes a removable dispensing head. The dispensing head is configured in particular as a screw top or as a plug in top or connected with the outer shell through a respective snap locking connection. Besides a removable closure or a dispensing head there is also the option that the outer shell for example in the base portion includes a flap or a cover thus permitting access to the containers arranged in the interior. The closure provided at the dispenser is advantageously also configured as an applicator and thus offers the advantages described supra.

As a compensation for the retrieved amount of substance air flows in the dispenser into the intermediary space between the outer wall and the container. In order to facilitate a quick refill of the intermediary space with exterior air the inlet valve is configured as a valve that is arranged in the outer wall or in the closure. For a valve in particular an arrangement of a so called ball valve or needle valve is suitable. The valve is opened by a vacuum that is provided in the container after substance removal or the valve is advantageously opened by gravity in that the dispenser is placed upright again from the preferred upside down position while being used. The valve can be integrally formed when shaping the dispensing head, in particular as a cage for guiding a small ball. This configuration is an invention in itself since it provides plural functions. Thus a ball valve or needle valve of this type provides long term storage without intensive pressure variations (e.g. from temperature changes) in an open position of the dispenser and thus in an open position of the valve so that also a transportation on aircraft is facilitated. When filling the containers compressed air can be provided to the balancing valve in order to press the foil bags flat before filling them with the substance, thus evacuate them. In the operating position (overhead position) the gravity actuated ball together with a sealing seat facilitates safe sealing and thus simple pressure loading.

Furthermore the base portion of the outer wall can have a rounded shape so that the dispenser is stored upside down or lying flat wherein leakage is prevented. Thus, the dispenser cannot be put upside down which also prevents unintentional run out. Thus a so called ball valve is useable as a venting valve.

BRIEF DESCRIPTION OF THE DRAWINGS

Further advantages features and details of the invention can be derived from the subsequent description of advantageous embodiments of the invention with reference to drawing figures, wherein:

FIGS. 3*a* and 3*b* illustrate two views of an oval outer shell of the dispenser;

FIGS. 4*a*, 4*b*, 4*c* and 4*d* illustrate a plural views of an unfilled container that is configured as a bag;

DETAILED DESCRIPTION OF THE PREFERRED EMBODIMENTS

Figure 1B:
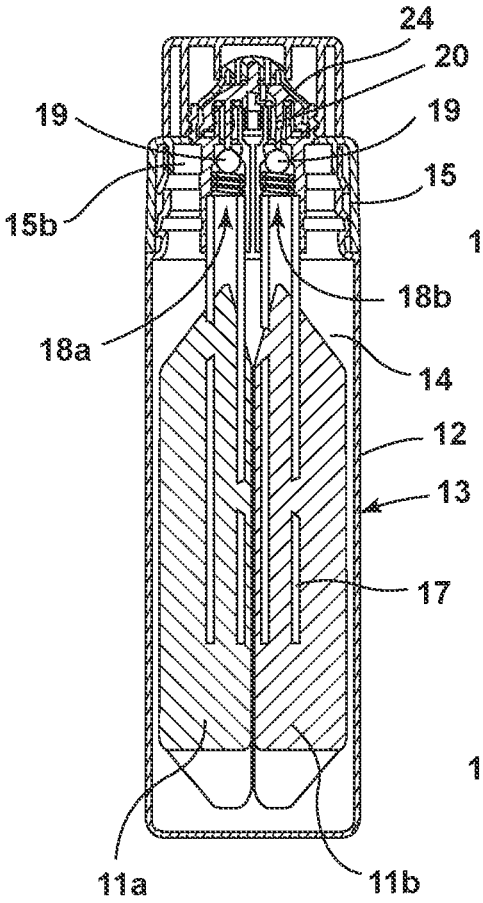
FIGS. 1*a*, 1*b* and 1*c* illustrate schematic representations of a dispenser according to the invention in a perspective view and into longitudinal sectional views that are offset by 90°.
Figure 1C:
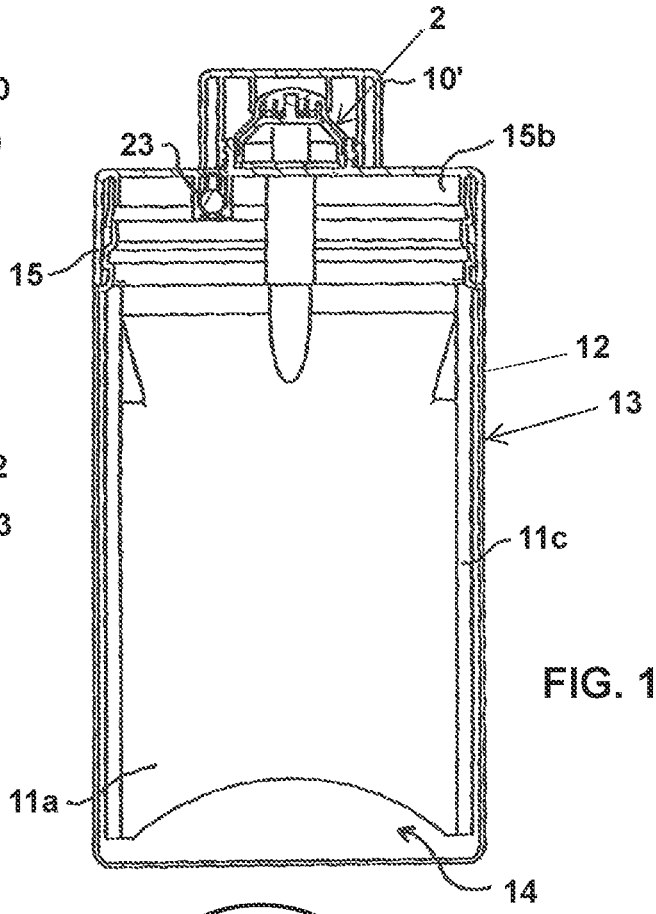
Figure 1A:
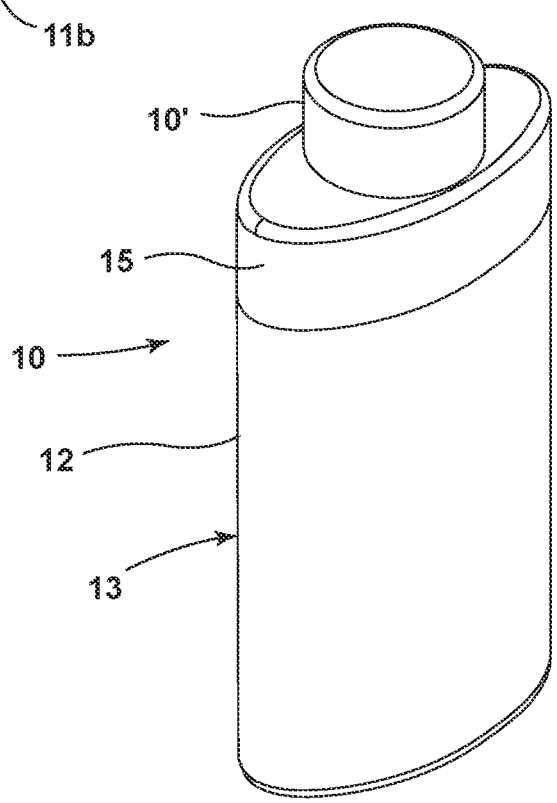
Figure 2C:
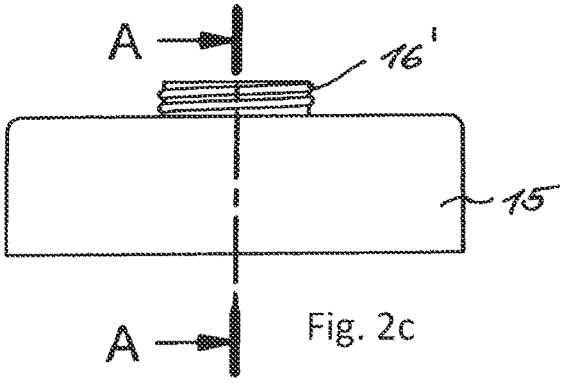
FIGS. 2*a*, 2*b*, 2*c*, 2*d*, 2*e* and 2*f* illustrate several views of a dispensing head provided at the dispenser.
Figure 2D:
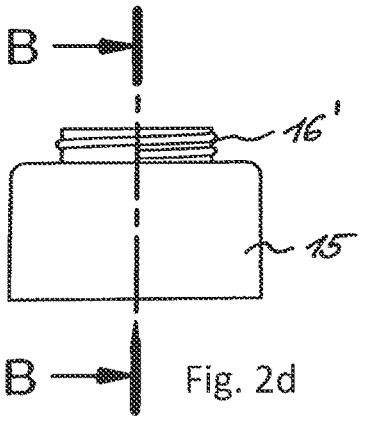
Figure 2B:
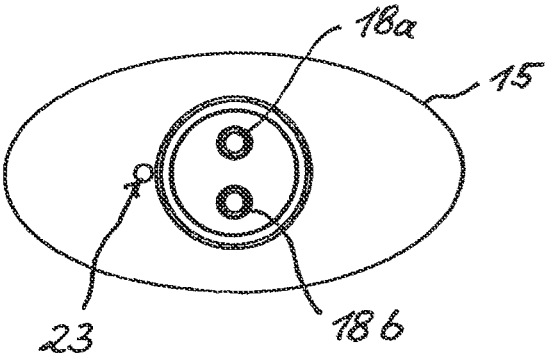
Figure 2A:
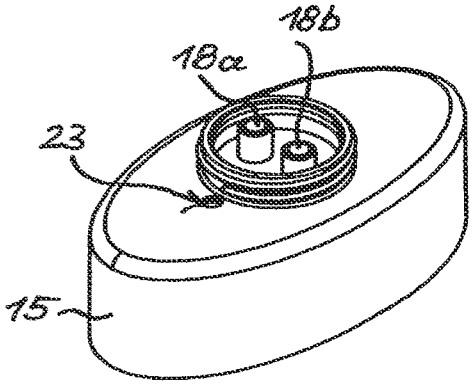
Figure 2E:
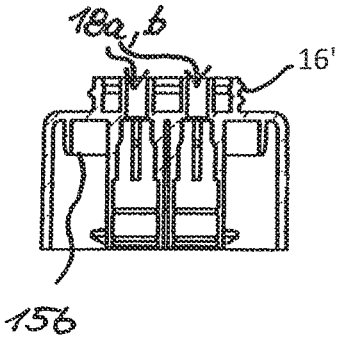
Figure 2F:
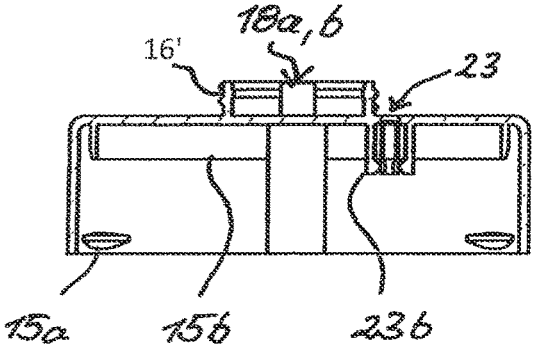

FIGS. 1*a*-1*c* illustrate an embodiment of the dispenser 10 according to the invention which includes two containers 11*a, b*. The containers 11*a, b* are thus arranged in an outer shell 13 of the dispenser 10 wherein the exterior shell is made from a deformable material, for example PE, PP or PET. The outer wall 12 of the outer shell 13 is configured easily deformable, in particular provided in an oval shape so that it is easily apprehensible by a human hand. Since the dispenser 10 is stored in a stand up position as illustrated in FIG. 1 the deformability of the outer wall 12 is selected so that the outer shell 13 facilitates a safe standing storage of the dispenser. The containers 11*a, b* arranged in an interior of the outer shell 13 are also made from a deformable material wherein the material thickness however can be very thin, in particular the material can be a foil. Between the containers 11*a, b* and the outer wall 12 of the outer shell 13 there is an intermediary space 14 which is filled with exterior air through a balancing valve 23 that is described infra (c.f. FIGS. 1*a*-1*c*), right sectional view. The dispenser 10 also includes a screw top 10' which covers the dispenser 10 (herein with an applicator 24, c.f. FIGS. 6*a*-6*d*) and the ventilation hole of the balancing valve 23 dust proof in order to prevent contamination during extended storage.

In the left sectional view (centrally through the narrow side of the dispenser) the filled containers 11*a, b* are visible which adjoin the dispensing head 15 together with their dispensing openings 18*a, b* and with their filling valves 19, in particular for liquids. The dispenser 10 illustrated herein is a disposable container, wherein the containers 11*a, b* are not replaceable. In order to apply the cover 10', a thread 16' is provided herein (c.f. FIGS. 2*a*-2*f*). The output openings 18*a, b* for the stored substances in the embodiment are configured as spouts and thus provide a separate output of the substance stored in the containers 11*a, b* so that mixing can only be performed subsequently in the outlet from the applicator 24 or while being let out from the applicator 24. When the outer shell 13 and the dispensing head 15 are configured reusable the containers 11*a, b* can be removed after removing the dispensing head from the outer shell 13 (c.f. interlocking connection 15*a*/13*a* in FIGS. 2*a*-2*f*, 3*a* and 3*b*) and the containers can be replaced with "new containers 11*a, b*". The dispensing head 15 or the applicator 24 (c.f. FIGS. 6*a*-6*d*) includes mandrel shaped protrusions 20 at a lower end (c.f. FIGS. 6*a*-6*d*) wherein the mandrel shaped protrusions are inserted above the filling valves 19 and press the filling valves into an open position by snap locking the dispensing head that is reapplied to outer shell 13.

Figure 5A:
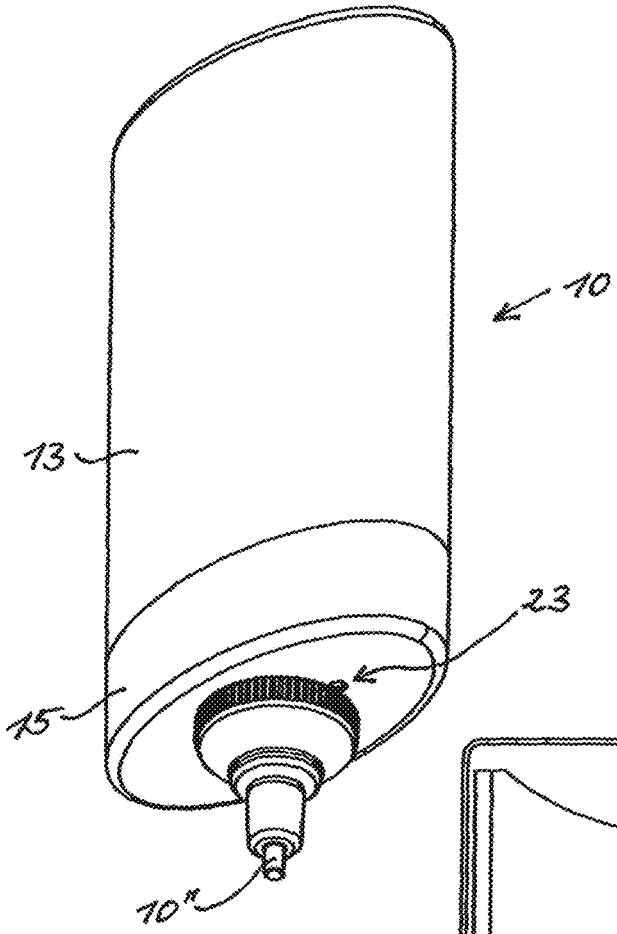
FIGS. 5*a* and 5*b* illustrate a dispenser in an advantageous upside down operating position.
Figure 5B:
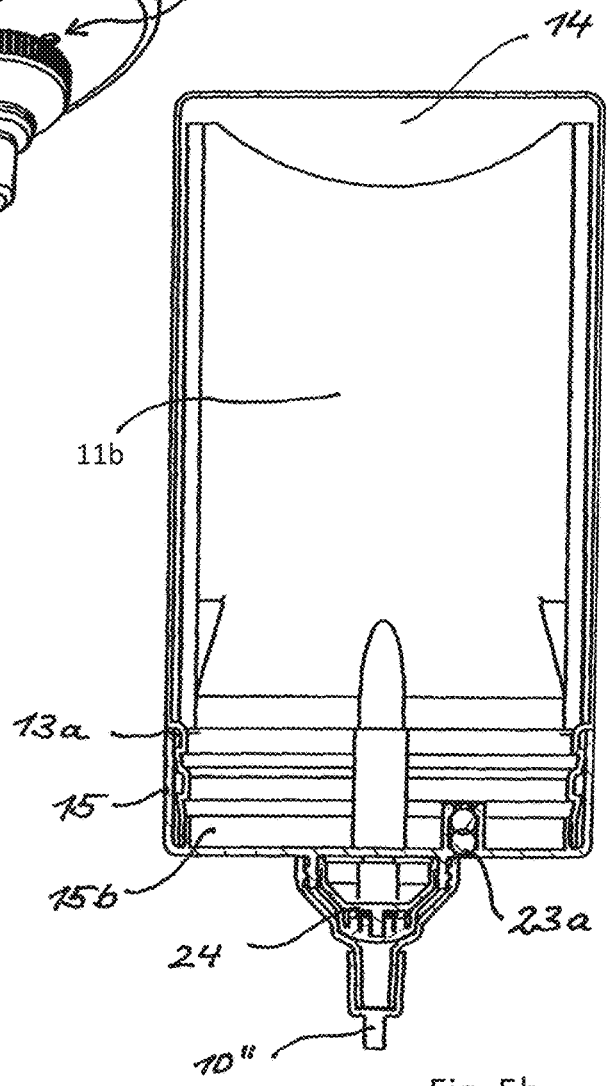
Figure 6A:
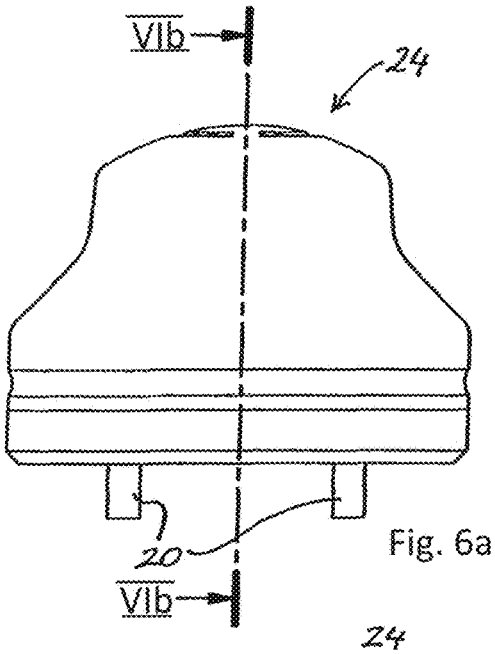
FIGS. 6*a*, 6*b*, 6*c* and 6*d* illustrate a plural views of an advantageous applicator.
Figure 6B:
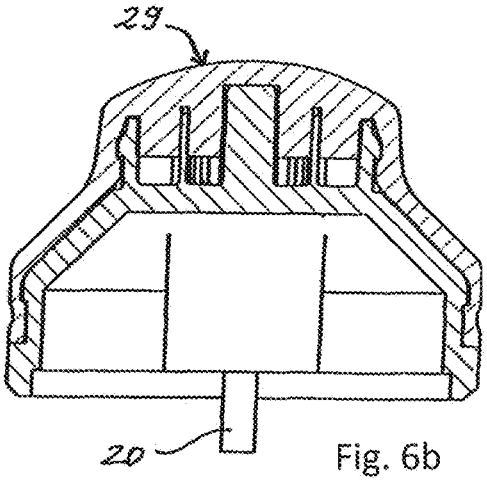
Figure 6C:
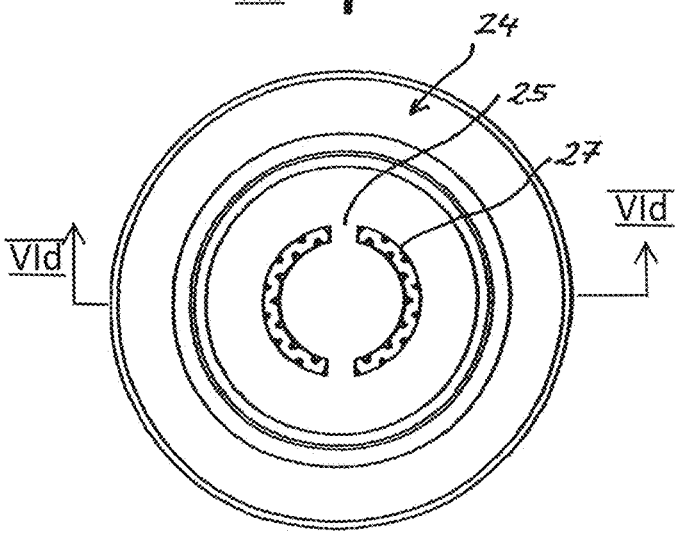
Figure 6D:
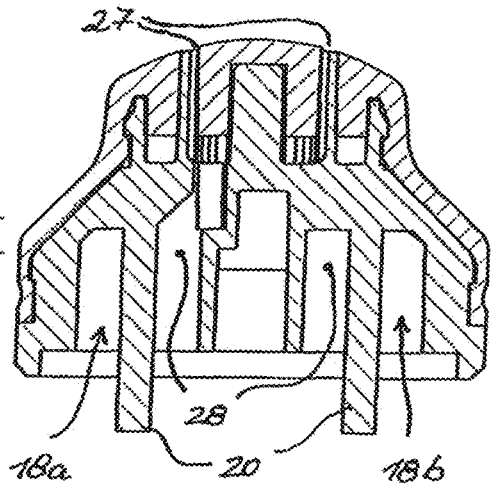

The balancing valve 23 illustrated in the right sectional view is embodied as a ball valve and facilitates air access in the position of FIGS. 1*a*-1*c*, but prevents letting out air in the overhead operating position (c.f. FIGS. 5*a* and 5*b*). In addition to an embodiment as gravity actuated ball valve as illustrated in FIGS. 1*a*-1, 5*a* and 5*b* there is also the option to provide the balancing valve as a needle valve.

FIGS. 2*a*-2*f* illustrates the dispensing head 15 and plural sectional views along the sectional lines A-A (broadside) and B-B (narrow side). In the left lower sectional view of FIGS. 2*a*-2*f* no filling valves are provided in the output openings 18*a, b* differently from the left upper sectional view in FIGS. 1*a*-1*c* since the filling valves are not necessarily required for the pasty substances but are required for liquids. Furthermore a circumferential seal lip 15*b* is visible which interacts closely with the upper edge 13*b* (c.f. FIGS. 3*a* and 3*b*) of the outer shell 13 so that the entire arrangement besides the balancing valve is configured pressure tight. When the dispenser 10 is arranged as a disposable arrangement interlocking connection 5*a*/13*a* can be replaced by a permanent welded connection of the dispensing head 15 with the outer shell 13. Additionally there is the option that the inner containers 11*a, b* are inserted into the outer shell 13 and the outer shell 13 is welded thereafter. The two or more containers 11*a, b* can also be connected with the outer wall 12 in the one way configuration. By the same token the two or more containers can also be coupled with each other by tube 17 leading to the output openings 18*a, b* (c.f. FIGS. 4*a*-4*d*). These tubes 17 with openings 17' stabilize the containers 11*a, b* made from a thin wall material like e.g. foil and prevent a collapsing of the containers caused by progressive depletion. In the embodiment the substances stored in the containers 11*a, b* are put out by an applicator 24 that is centrally arranged on a top side of the dispenser 10.

The applicator 24 that is illustrated in more detail in FIGS. 6*a*-6*d* includes 2 channels 28 for separately feeding the substances stored in the containers 11*a, b* wherein the output is provided at an annular gap 27 which is interrupted by a connecting bar 25. This embodiment provides a separate feeding of the substances to the applicator 24 or to a top side with a cambered applicator surface 29. An applicator 24 of this type is described in more detail in DE 20 2011 002 558 U1.

As described supra an intermediary space 14 that is filled with the air is arranged between the outer wall 12 of the dispenser 10 and the containers 11*a, b*. This intermediary space 14 assures even distribution of pressure imparted upon the outer wall 12 which is necessary for retrieving the substances from the containers 11*a, b*. After retrieving a particular amount of a substance (in the operating or upside down position according to FIGS. 5*a* and 5*b*) outside air flows through the balancing valve 23 into the intermediary space 14 such that even pressure distribution is in turn provided and the outer wall 12 of the dispenser 10 is brought back into its starting position. The dispenser 10 that is put right side up again as illustrated in FIGS. 1*a*-1*c* thus has sufficient stand safety and looks full.

FIGS. 4*a*-4*d* illustrates an advantageous embodiment of the unfilled or empty containers 11*a, b* configured as foil bags which are welded with seal seams 11*c*. The seal seams can have any shape. It is also possible to combine two containers 11*a, b* by continuous seal seams 11*c* to form a two cavity bag which is then inserted into the outer shell 13. The outer wall 12 eventually determines the looks of the dispenser 10 and thus contributes to its differentiation.

In addition to the illustrated arrangement of two containers 11*a, b* with identical volume there is also the option that the containers 11*a, b* have different volumes. Additionally the dispensing head 15 or the applicator 24 can have diameter reduced output openings 18*a, b*, so that a constant ratio of substances is always put out when the dispenser 10 is evenly loaded with pressure. For example an additive mixing of a smaller amount of a substance to a larger amount of additional substances can be performed. This is advantageous for example when the dispenser 10 is used for multi component glues which only require a small additive mixing of a hardener. Besides the use with glues there is certainly also the option to use the dispenser 10 for cosmetics, wherein for example a connection of the substances for forming for example a care substance is only performed when the substances exit the dispenser 10. Through the configuration of the applicator 24 as illustrated in FIGS. 6*a*-6*d* a spreading of the cosmetic substances exiting from the dispenser 10 can be performed during application, for example on the skin or on the lips.

According to FIGS. 5*a* and 5*b* the dispenser 10 also includes an applicator 24 that is adjoined on a right side by the balancing valve 23. This prevents an exit of air from the intermediary space 14 of the dispenser 10 in the upside down position with the downward dropping sealing ball against a sealing seat, so that the container 11*a, b* can be compressed upon a manual pressure loading of the outer wall 12 and the substances are put out. After rotating out of the overhead position wherein the sealing ball 23*a* falls back again gravity induced within the cage 23*b*, c.f. position in FIGS. 1*a*-1*c*, air can flow in through the balancing valve 23. The embodiment according to FIGS. 5*a* and 5*b* illustrates a modified version of the cover 10" namely with a spout shaped extension which can be cleaned after a use using the plug on cap (c.f. DE 20 2008 015 776 by the applicant).

In addition to the configuration of the applicator 24 with a defined diameter of the output openings 18*a, b* also using an adjustable system is feasible where a cross section or a size of the output openings 18*a, b* is variable as a function of the amount to be dispensed. The dispenser 10 according to the invention thus forms a cost effective alternative to dispensers 10 with pumps and thus facilitates a relatively precise dosing or a precisely adjustable mixing ratio of the dispensed substances due to the air filled intermediary space 14 due to the absolutely identical pressure ratios which impact the containers 11*a, b* arranged in the dispenser 10 since the containers 11*a, b* are arranged in the same pressure cavity or outer shell 13.

In particular the balancing valve 23 in particular in combination with the filling valves 19 in the containers 11*a, b* facilitates effective filling of the containers 11*a, b* so that a compressed air connection can be applied to the balancing valve 23 so that the intermediary space 14 of the preassembled can be loaded with compressed air. Since the outer shell 13 and the dispensing head 15 are sealed e.g. through the seal lip 15*b* and the applied upper edge 13*b* the air pressure impacts the inserted containers 11*a, b* and presses them flat, thus almost evacuates them. Then a commercial filling head can be applied to the openings 18*a, b* (c.f. in particular FIGS. 2*a*-2*f* center perspective view) for both substances so that the components can be filled in the containers 11*a, b* substantially without air, this is particularly important for a subsequent uniform feeding out the dispenser 10. After removing the filling head the filling valves 19 or pasty substances close the dispensing openings 18*a, b* until the dispenser is used or an applicator is applied which opens the output openings 18*a, b* with the spike shaped protrusions 20.

Figure 7A:
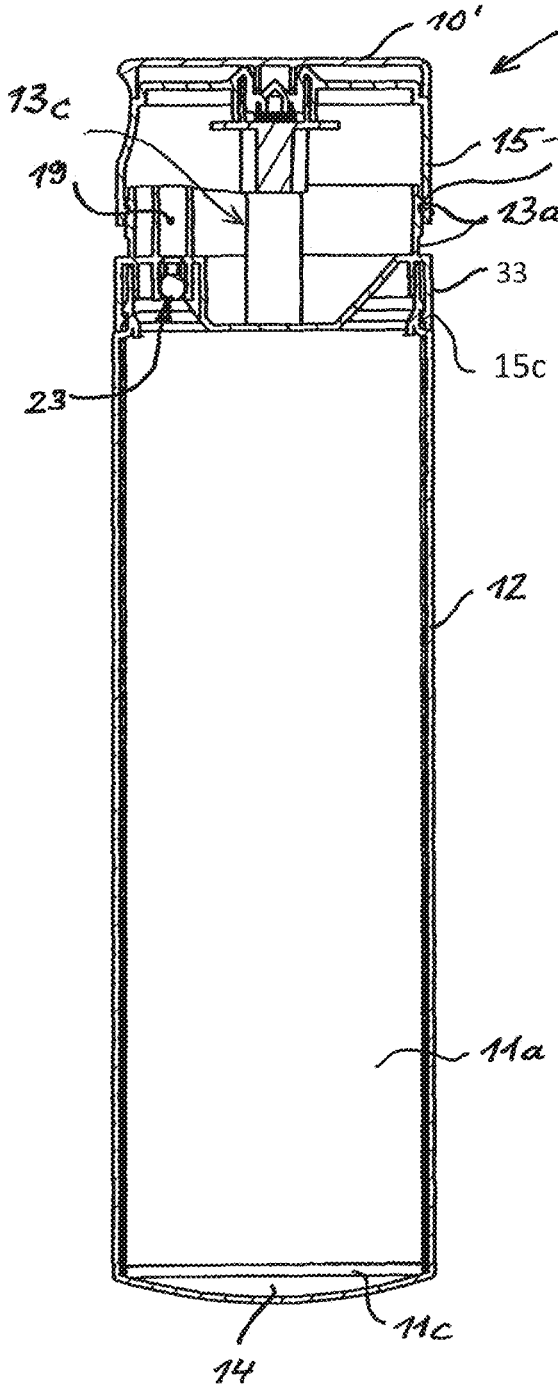
FIGS. 7*a* and 7*b* illustrate a schematic view of an advantageous dispenser into longitudinal sectional views (offset relative to each other by 90°)
Figure 7B:
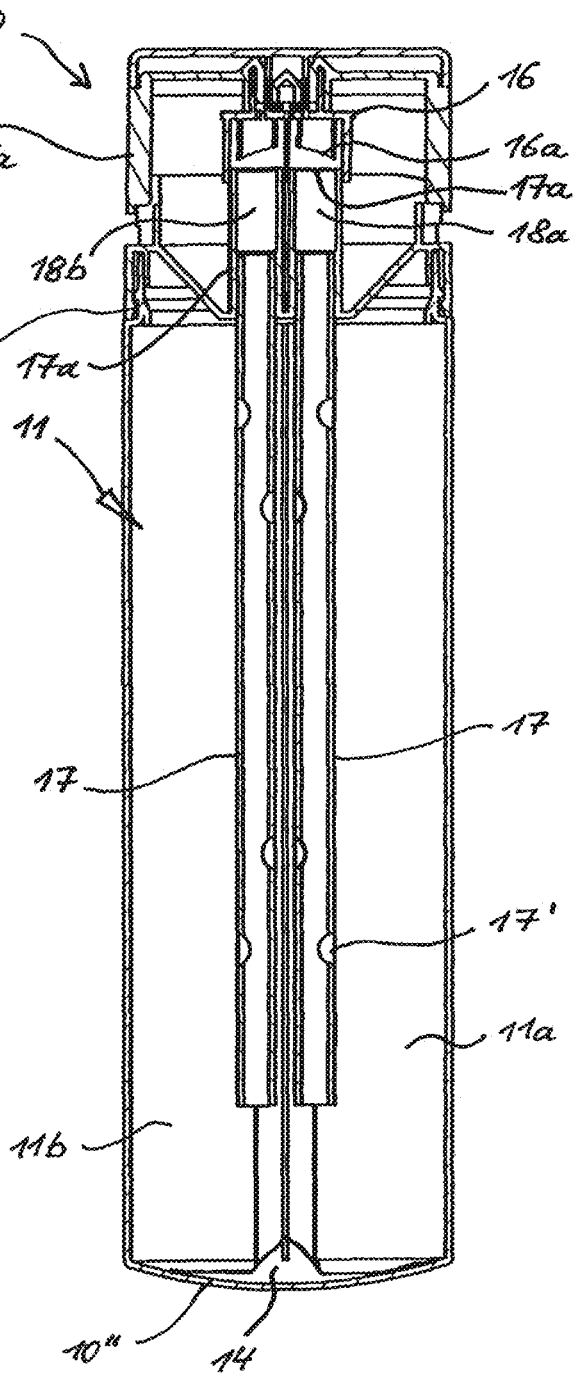

FIGS. 7*a* and 7*b* illustrates another embodiment of the dispenser 10 according to the invention which includes 2 containers 11*a, b* as a container arrangement 11 in this embodiment. The containers 11*a, b* are thus arranged with their upper portion (outlet portion 13*c*) within an outer shell 33 of the dispenser 10 wherein the outer shell is made from a relatively stable plastic material PE or PP. Like in the embodiment according to FIG. 1-6 wherein identical reference numerals are used for like components the outer wall 12 that adjoins in downward direction is configured more easily deformable relative to the more stable outer shell 33 so that it can be gripped and squeezed by a human hand. The deformability of the outer wall 12 is selected so that it facilitates a safe standing set up of the dispenser 10 together with the outer shell 33 unless a cambered base 10" is provided like in this case. The containers 11*a, b* that are arranged in an interior of the outer wall 12 are also made from a deformable material wherein a material thickness however can be very small, in particular like a foil. Between the containers 11*a, b* and the outer wall 12 there is an intermediary space 14 which is filled with outside air through the balancing valve 23 described supra, c.f. FIGS. 1*a*-1*c* left sectional view. The dispenser 10 also includes a cover 10' c.f. also FIGS. 9*a* and 9*b* in open condition which covers the dispenser 10 and the ventilation hole of the balancing valve 23 dust proof in order to prevent contamination during long term storage.

In the right sectional view of FIG. 7*b* (centrally through the cylindrical dispenser 10) the filled containers 11*a* and 11*b* are visible wherein the containers transition with their dispensing openings 18*a, b* and the outlet portion 13*c* into a dispensing head 15. The dispensing openings 18*a, b* for the stored substances are configured spout shaped in the embodiment and facilitate a separate output of the substance stored in the containers 11*a, b* so that a mixing can only be performed subsequently in the outlet or during exit from the dispensing head 15. When the outer shell 33 and the dispensing head 15 are configured as reusable arrangements, the containers 11*a, b* can be retrieved after removing the dispensing head 15 from the outer shell 33 (c.f. snap locking connections 15*a*/13*a*) and can be replaced with new containers 11*a, b*. The dispensing head 15 includes lugs 15*a* in its lower portion which engage a respective upper groove 13*a* (c.f. also FIGS. 8*a*-8*c* of the outer shell 33). Thus also a second lower groove 13*a* is provided at a distance from the outlet portion 13*c*. Compared to the position illustrated herein the dispensing head 15 can be pressed even further downward, so that the lugs then engage a second lower groove 13*a* (c.f. FIGS. 9*a* and 9*b* and also FIGS. 11*a* and 11*b*) so that subsequently described spikes or points 16*a* penetrate or open a diffusion seal 17*a*.

Figures 9A, 9B:
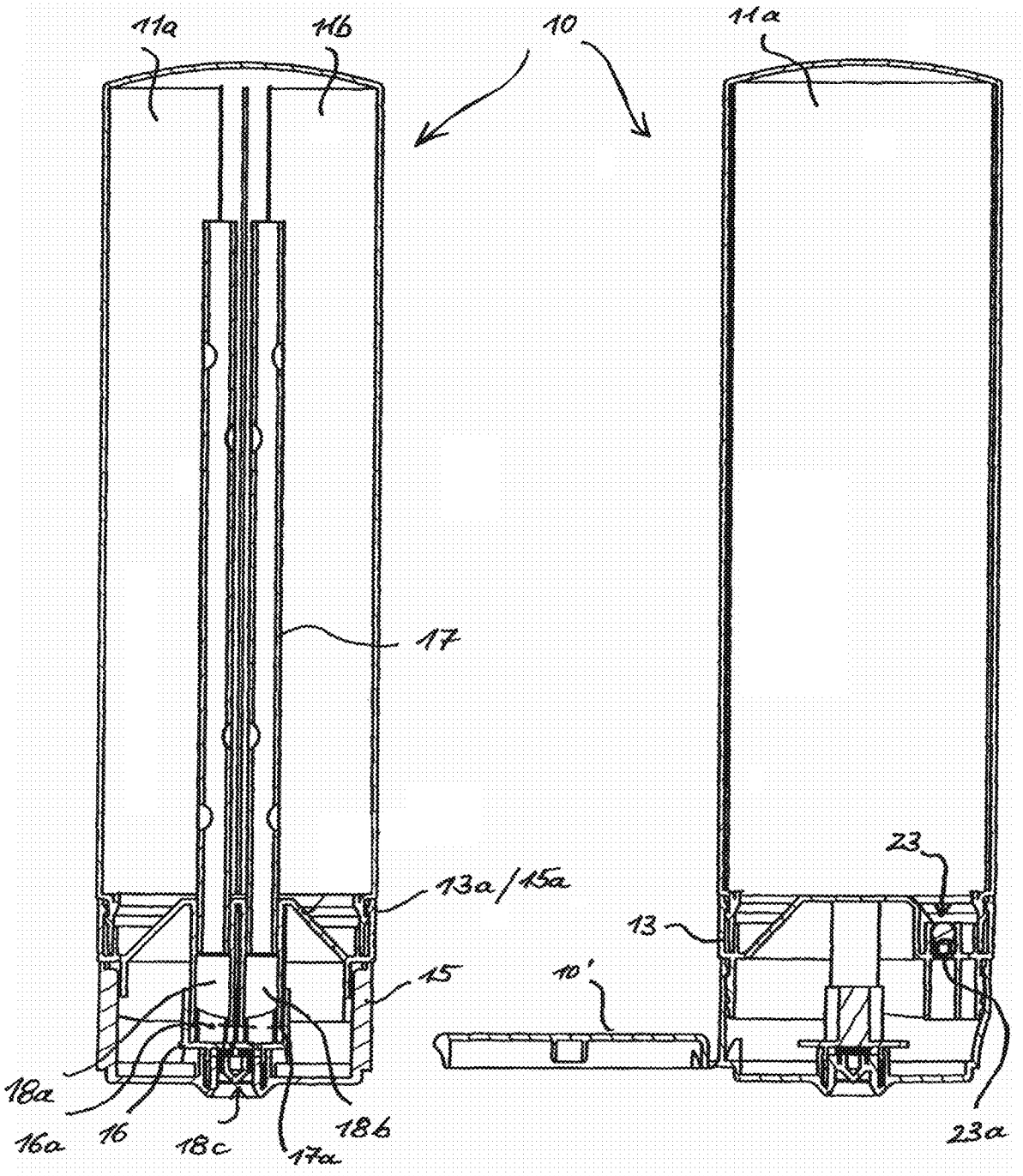
FIGS. 9*a* and 9*b* illustrate a dispenser in upside down position as an advantageous operating position.
Figure 10:
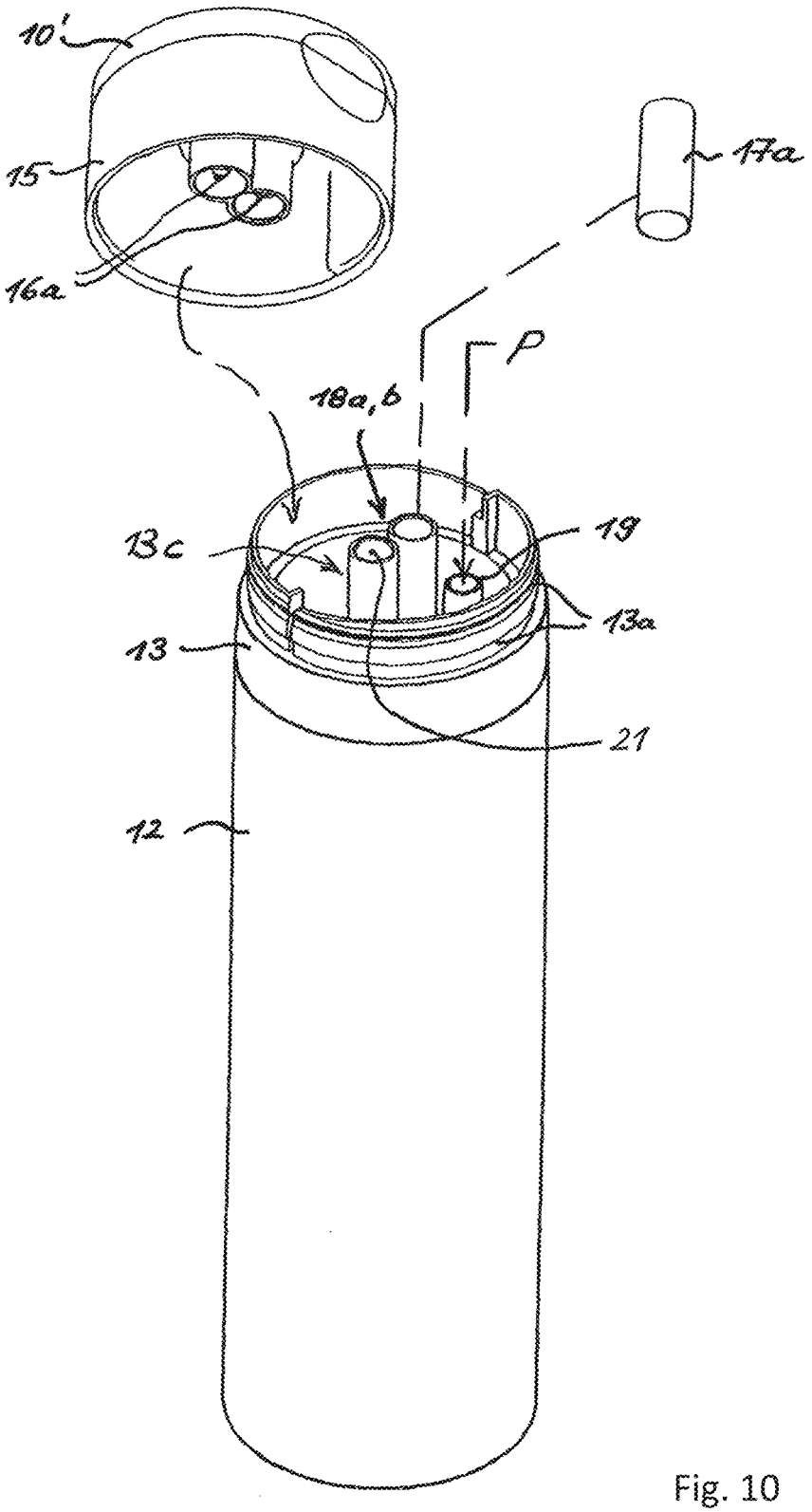
FIG. 10 illustrates an exploded view of the dispenser in the filling position.

The balancing valve 23 illustrated in the left sectional view of FIG. 7*a* is configured as a ball valve in the embodiment and facilitates air access in the position in FIGS. 7*a* and 7*b*, however prevents air exit in the upside down cooperating position (c.f. FIGS. 9*a* and 9*b*). In addition to an embodiment as a gravity actuated ball valve as illustrated herein there is also the option to provide the balancing valve 23 as needle valve. An extension of the balancing valve 23 is thus configured similar to the outlet portion 13*c* as a "turret" which can be used as a filling valve 19 during filling of contents (c.f. FIG. 10).

Figure 8C:
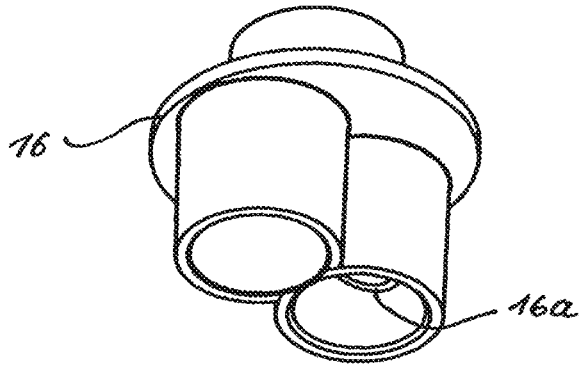
FIGS. 8*a*, 8*b* and 8*c* illustrate a plural views of an inner component (so called enveloping sleeve) of the dispensing head and two perspective views of the outer shell which is arranged below the dispensing head.
Figure 8B:
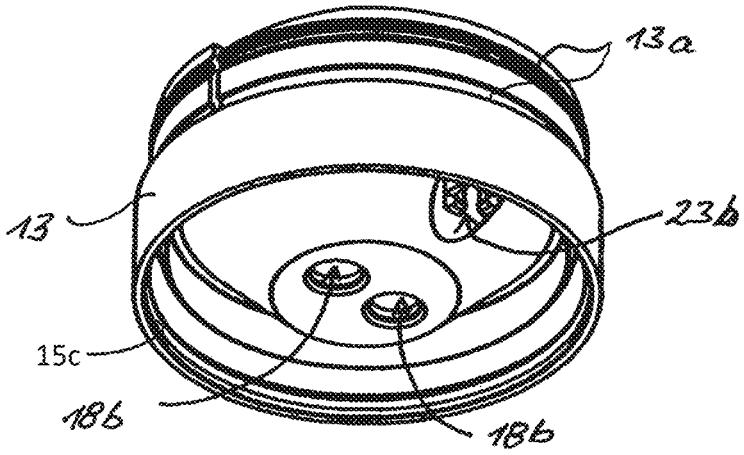
Figure 8A:
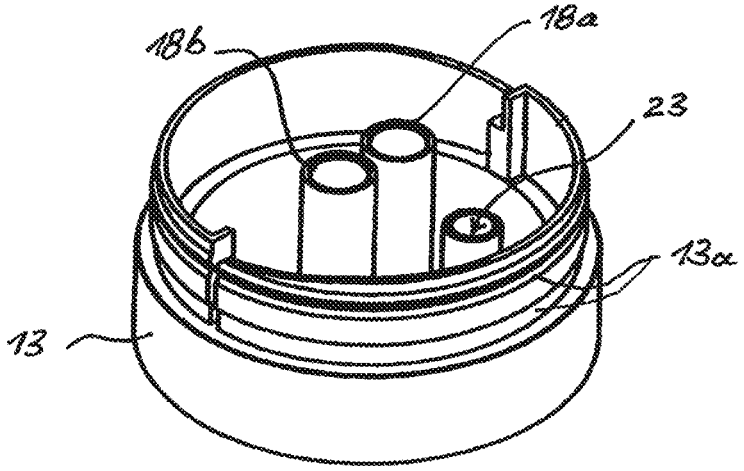

FIGS. 8*a*-8*c*, upper perspective view illustrates a circumferential or enveloping sleeve 16 inserted into the dispensing head 15 from below which includes 2 points 16*a* in its interior (c.f. FIGS. 7*a*, 7*b*, 9*a* and 9*b*) which are used for penetrating or opening the diffusion seal 17 when the dispensing head 15 is pressed further downward from the position in FIGS. 7*a* and 7*b* (lugs 15*a* in upper position) and interlocks there in the grooves 13*a*.

In the center perspective view of FIGS. 8*a*-8*c* the cap shaped outer shell 13 is illustrated as a base portion of the dispensing head 15 from below. Thus the boundaries for the dispensing openings 18*a, b* are visible together with the integrally cast cage 23*b* of the balancing valve 23 and a seal lip or seal edge 15*c* for a tight connection with the outer wall 12 (c.f. FIGS. 7*a* and 7*b*). In the lower perspective view of FIGS. 8*a*-8*c* the spout shaped dispensing openings 18*a, b* which essentially form the outlet portion 13*c* are visible and the filling valve 19 recited supra. The tubes 17 leading to the dispensing openings 18*a, b* are advantageously coupled together. These tubes 17 with openings 17' stabilize the containers 11*a, b* made from a thin wall material like e.g. foil and prevent them from collapsing while being depleted. Through these spouts of the dispensing openings 18*a, b* an additional diffusion seal 17*a* in particular made from metal is applied (c.f. FIG. 10) or sealed with a multi-layer foil or by vapor deposition in order to prevent oxygen access to the substance over a long time. In the embodiment putting out the substances stored in the containers 11*a, b* is performed through a central outlet 18*c* (c.f. FIGS. 9*a* and 9*b*) arranged on top side of the dispenser 10.

As described supra there is an intermediary space 14 between the outer wall 12 of the dispenser 10 and the containers 11*a, b* which is filled in air. This intermediary space 14 facilitates an even distribution of pressure applied to the outer wall 12 wherein the pressure is required for removing the substances from the containers 11*a, b*. After removing a certain amount of a substance in the operating position or upside down position according to FIGS. 9*a* and 9*b* outside air flows through the balancing valve 23 into the intermediary space 14 and causes on the one hand side that an even pressure distribution is provided during the next retrieval of substance and on the other hand side that the outer wall 12 of the dispenser 10 is brought back into its starting position.

In addition to the arrangement of two containers 11*a, b* with identical volumes there is also the option for the containers 11*a, b* to have different volumes. Furthermore the dispensing head 15 can have diameter reduced dispensing openings 18*a, b* so that a respective ratio of substances is put out for an even pressure loading of the dispenser 10. For this embodiment of the dispenser 10 then for example an additive mixing of a smaller amount of a substance to a larger amount of additional substances can be performed. This is advantageous for example when the dispenser 10 is used for multi component glues which only require additive mixing of a small amount of hardener. Besides a use with glues there is certainly also an option to use the dispenser 10 for cosmetics, wherein a connection of the substances performing for example a care substance is only performed when the substances exit the dispenser 10. Using an applicator a spreading of the cosmetic substances exiting from the dispenser 10 can be performed during spreading, for example on the skin or on the lips.

According to FIGS. 9*a* and 9*b* the sealing ball 23*a* that drops in the upside down position downward against a seal seat prevents an exit of air from the intermediary space 14 of the dispenser 10 so that the containers 11*a, b* are compressed for a manual pressure loading of the outer wall 12 and the substances are being dispensed. After rotating out of the upside down position wherein the sealing ball 23*a* drops back again gravity induced within the cage 23, c.f. position in FIGS. 7*a* and 7*b* an inflow of air can be provided through the balancing valve 23. The dispenser 10 is advantageously stored lying flat after utilization as commenced by opening the diffusion seal 17.

Additionally the balancing valve 23 together with the filling valve 19 in the containers 11*a, b* facilitates an effective filling of the containers 11*a, b* as illustrated in FIG. 10. Thus a compressed air connection can be applied to the balancing valve 23 through the filling valve 19 so that the intermediary space 14 of the preassembled dispenser 10 can be loaded with compressed air. Thus the air pressure impacts the inserted still empty containers 11*a, b* and presses them flat thus essentially with no air in them. Then a typical filling head for both substances can be applied to the adjacent openings 18*a, b* so that the components are filed into the containers 11*a, b* essentially without air. This is relevant in particular for a subsequent even feeding out of the dispenser 10 but also for storing oxidation sensitive materials. After removing the filling head the diffusion seals 17*a*, in particular provided as aluminum caps are applied to the spout shaped dispensing openings 18*a, b* as well as the dispensing head 15 initially similar to the position in FIGS. 7*a* and 7*b* wherein the diffusion seal 17*a* are not yet perforated. For operations the dispensing head 15 is then pressed further so that the lugs 15*a* interlock in the lower groove 13*a* and the diffusion seal 17*a* is penetrated by the spikes 16*a*. Thus the spikes 16*a* operate similar to the protrusions 20 in FIGS. 6*a*-6*d*. Furthermore a blocking ball 21 is advantageously inserted into the respective dispensing opening 18*a, b* wherein the blocking ball 21 can seal the container arrangement 11 also without spring loading (c.f. compression spring in FIGS. 1*a*-1*c*) as will be described infra.

FIGS. 11*a*-11*d* illustrates a modified embodiment similar to the illustration in FIGS. 7*a* and 7*b*. Therefore the same reference numerals apply accordingly as in the preceding description. In the right illustration thus only over the right dispensing opening 18*a* an aluminum cap is drawing as a diffusion seal 17*a* for emphasis in a thicker line. In practical applications the diffusion seal 17*a* can be very thin, e.g. also configured as a coating or vapor deposition with thus it is sufficient that the substance carrying central outlet portion 13*c* is coated, wherein also the entire cap shaped outer shell 13 can be vapor deposited. Thus the outer shell 13 can be injection molded with economical plastic materials.

Figure 11B:
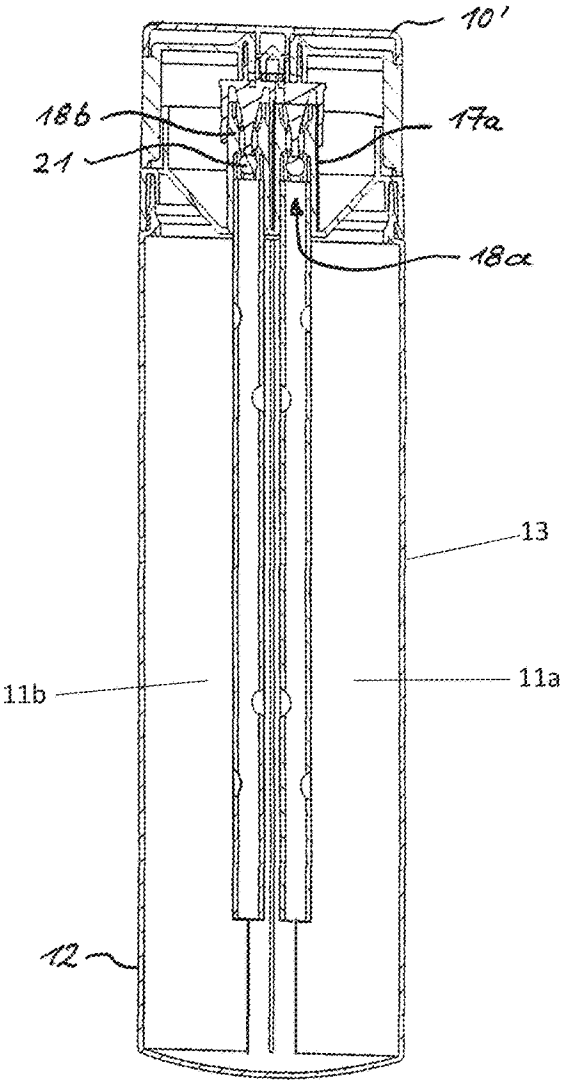
FIGS. 11*a* and 11*b* illustrate an embodiment similar to the embodiment in FIGS. 7*a* and 7*b*.
Figure 11A:
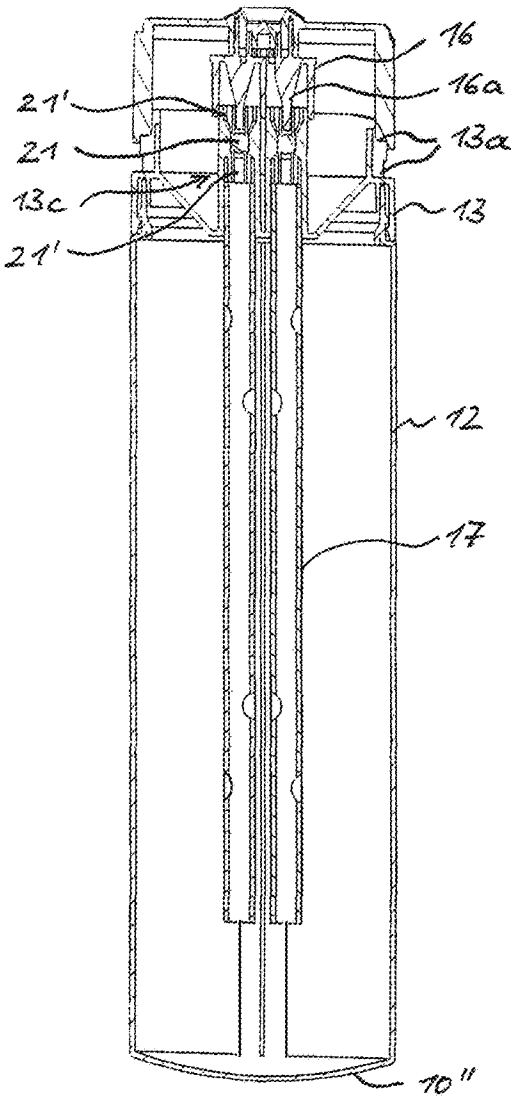
Figure 11C:
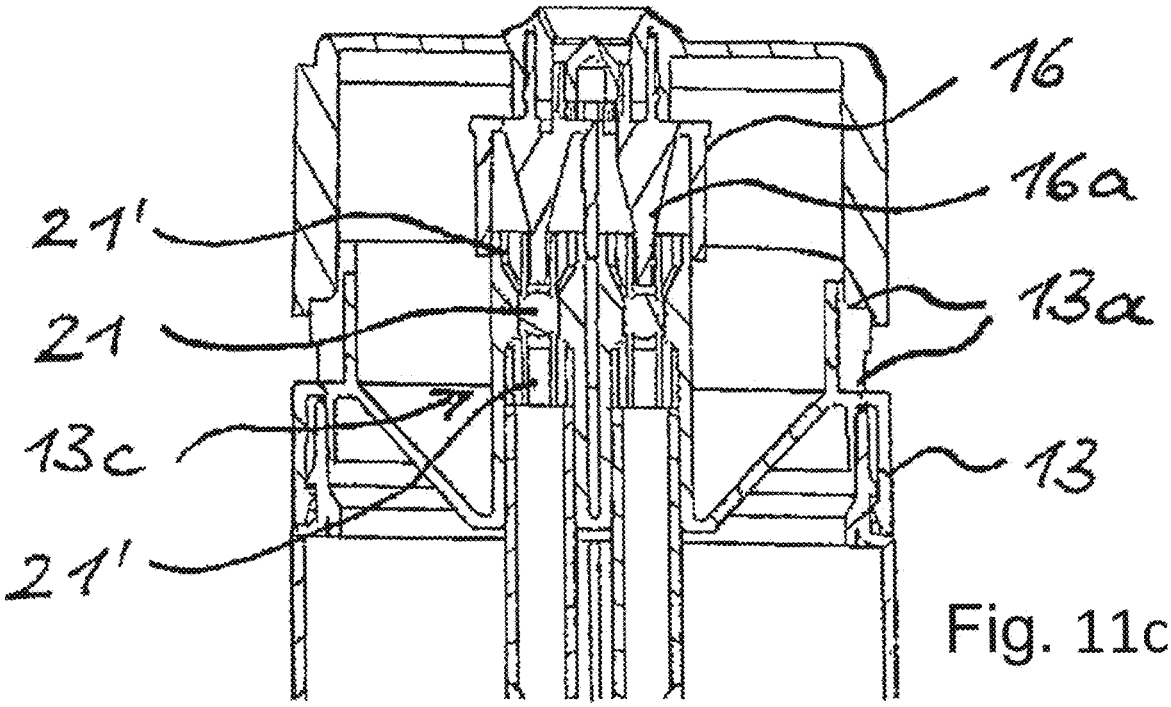
FIGS. 11*c* and 11*d* illustrate an enlarged partial view of the embodiment as illustrated in FIGS. 11*a* and 11*b*.
Figure 11D:
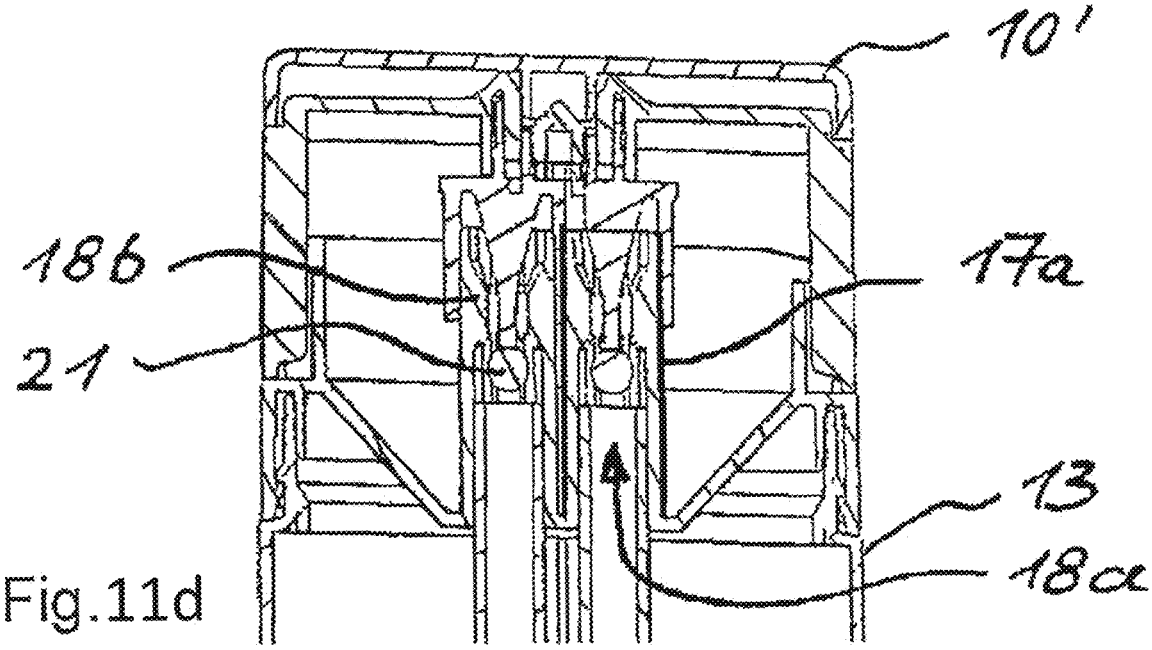

As stated supra a respective blocking ball 21 made from metal or glass is inserted within the dispensing openings 18*a, b* in a particularly advantageous embodiment (c.f. FIG. 10 in the idle position) which is pressed further downward by the mandrel shaped spikes 16*a* for operating the dispenser 10, thus the blocking ball is opened together with the diffusion seal 17*a* in that the dispensing head 15 (from the left position) is pressed downward (into the right end position) and then interlocked in the lower groove 13*a*. In FIGS. 11*a* and 11*b*, left illustration an intermediary position is shown into which respective blocking ball 21 is pressed after filling relative to the idle position in FIG. 10 by the known filling head into a central contraction. Thus the container content is safely sealed for long term storage. Above and below this contraction small radial bars 21' are formed into the dispensing opening 18*a, b* so that the respective filling can be performed in the upper position of the blocking head 21 (c.f. FIG. 10) quickly and unimpeded so that the blocking ball 21 is pressed into the center position at the contraction thereafter so that the containers 11*a, b* are safely sealed. For a subsequent use of the dispenser 10 the dispensing head 15 is pressed down further (FIGS. 11*a* and 11*b*, right illustration) so that the spikes 16*a* or similar protrusions 20 do not only puncture the diffusion seals but also move the blocking balls 21 from the center contraction (sealing position) downward into the expended portion so that the respective substance can flow out easily.

REFERENCES AND DESIGNATIONS

10 dispenser
10' cover
10" base
11*a, b* container
11*c* sealing seam
12 outer wall
13 outer shell
13*a* grooves
13*b* upper edge
13*c* outlet portion
14 intermediary space
15 dispensing head
15*a* lugs
15*b* seal lip of dispensing head
16 enveloping sleeves
16*a* points
16' thread
17 tube
17' openings
17*a* diffusion seal
18*a, b* dispensing opening
18*c* central outlet
19 filling valve
20 protrusion
21 blocking ball
21' radial bars
23 balancing valve
24 applicator
25 connecting bar
27 annular gap
28 channels
29 application surface
33 outer shell

The invention claimed is:

1. A dispenser for substances, comprising:

an outer shell with a deformable outer wall which envelops a deformable container arrangement and at least one balancing valve for balancing air;

wherein an air filled intermediary gap is located between the outer wall and the container arrangement and the dispenser is configured to dispense substances after pressure loading the outer shell;

wherein the container arrangement includes at least two containers for separate storage of liquid or pasty substances;

wherein the at least two containers are each sealingly connected with a common dispensing head; and wherein the dispensing head includes a self-closing filling valve which is configured to be openable by pressure during filling at least one of the at least two containers.

2. The dispenser according to claim 1, wherein the at least two containers are filled with substances that have substantially similar viscosities.

3. The dispenser according to claim 1, wherein the at least two containers comprise at least one of a thermoplastic plastic material, a metal foil, a multilayer foil, and a metal coating.

4. The dispenser according to claim 1, wherein the at least two containers comprise foil bags with plural seal seams.

5. The dispenser according to claim 1, wherein the at least two containers are combined as multi chamber bags.

6. The dispenser according to claim 1, further comprising:

an applicator that is connected with the outer shell, wherein the at least two containers are connected with the applicator through channels for separately feeding the substances.

7. The dispenser according to claim 1, wherein each of the at least two containers are at least one of replaceable and refillable containers.

8. The dispenser according to claim 7, wherein the dispenser includes a removable cover comprising at least one of a screw top and plug in closure.

9. The dispenser according to claim 1, wherein the containers respectively include a tube with openings.

10. The dispenser according to claim 1, wherein the balancing valve is arranged in at least one of the outer wall and the dispensing head, and wherein the balancing valve comprises at least one of a ball valve and a needle valve.

11. The dispenser according to claim 10, further comprising:

a gravity actuated sealing ball supported in a cage.

12. The dispenser according to claim 1, wherein the balancing valve is configured to be pressure loaded with compressed air for bleeding the containers of the liquid or pasty substances.

13. The dispenser according to claim 1, wherein the outer shell comprises an oval cross section configuration.

14. The dispenser according to claim 1, wherein the dispenser includes a cover.

15. The dispenser according to claim 14, wherein the cover is configured to close an outlet opening sealed tight, and wherein the outlet opening is adjacent to a mixing element.

16. The dispenser according to claim 1, wherein the outer shell includes a circular sealing lip and the dispensing head includes a circumferential seal lip that engages the circular sealing lip.

* * * * *